US010610756B2

(12) United States Patent
McGrail et al.

(10) Patent No.: US 10,610,756 B2
(45) Date of Patent: Apr. 7, 2020

(54) GOLF SWING AID APPARATUS AND METHODS OF USING THE SAME

(71) Applicant: Daniel McGrail, Fontana, WI (US)

(72) Inventors: Daniel McGrail, Fontana, WI (US); Marc Caldwell, Colorado Springs, CO (US)

(73) Assignee: Daniel McGrail, Fontana, WI (US)

( * ) Notice: Subject to any disclaimer, the term of this patent is extended or adjusted under 35 U.S.C. 154(b) by 0 days.

(21) Appl. No.: 16/427,984

(22) Filed: May 31, 2019

(65) Prior Publication Data

US 2019/0366181 A1 Dec. 5, 2019

Related U.S. Application Data

(60) Provisional application No. 62/678,657, filed on May 31, 2018.

(51) Int. Cl.

*A63B 69/36* (2006.01)
*A63B 69/00* (2006.01)
*A63B 102/32* (2015.01)

(52) U.S. Cl.

CPC ..... *A63B 69/0059* (2013.01); *A63B 2102/32* (2015.10)

(58) Field of Classification Search

CPC ..... A63B 69/3608; A63B 69/3611; A63B 69/0059
USPC ..... 473/138, 139, 212, 214, 217, 270–273, 473/275–277, 425, 458, 464, 518
See application file for complete search history.

(56) References Cited

U.S. PATENT DOCUMENTS 1,618,273 A * 2/1927 Davidson ..... A63B 21/0004 482/124
2,220,291 A * 11/1940 Savoy ..... A63B 65/127 473/217
2,482,930 A * 9/1949 Norwood ..... A63B 69/3673 36/1
2,498,006 A * 2/1950 Ridill ..... A63B 69/0059 473/217
3,606,341 A * 9/1971 Honbarger ..... A63B 69/3608 473/217
3,677,551 A * 7/1972 Schaus ..... A63B 69/0059 473/208
3,680,869 A * 8/1972 Brady ..... A63B 69/0059 473/213

(Continued)

FOREIGN PATENT DOCUMENTS

JP 3016735 U 10/1995
KR 10-1222325 1/2013

OTHER PUBLICATIONS

International Search Report and Written Opinion, PCT/US2019/034887.

*Primary Examiner* — Alvin A Hunter
(74) *Attorney, Agent, or Firm* — Scherrer Patent & Trademark Law, P.C.; Stephen T. Scherrer; Monique A. Morneault

(57) ABSTRACT

A golf swing aid apparatus comprises a stretchable strap that pulls a golfer's trailing elbow downward towards his or her torso during a golf downswing. The stretchable strap continues pulling the golfer's trailing elbow towards his or her torso until he or she strikes the golf ball, and then releases so that the golfer is free to follow through without impairment from the stretchable strap.

19 Claims, 7 Drawing Sheets

(56) References Cited

U.S. PATENT DOCUMENTS 3,861,688 A * 1/1975 Butler ..... A63B 69/3608 473/214
3,985,364 A * 10/1976 Brady ..... A63B 69/0059 473/213
4,892,317 A * 1/1990 Corder, Jr. ..... A63B 69/0059 473/212
5,062,643 A * 11/1991 Bibbey ..... A63B 69/3608 473/217
5,188,365 A * 2/1993 Picard ..... A63B 69/0059 473/212
5,263,916 A * 11/1993 Bobich ..... A63B 21/0004 482/121
5,303,927 A * 4/1994 Perry ..... A63B 69/0059 473/215
5,340,110 A * 8/1994 Mollis ..... A63B 69/0059 473/206
5,472,200 A * 12/1995 Miller ..... A43B 5/001 473/217
5,558,609 A * 9/1996 Olschansky ..... A63B 21/0552 482/122
5,704,856 A * 1/1998 Morse ..... A63B 21/0004 473/212
5,807,218 A * 9/1998 Nagatomo ..... A61F 5/3715 128/869
6,361,516 B1 * 3/2002 Hamel ..... A61F 5/0111 128/882
6,375,582 B1 * 4/2002 Harris ..... A63B 69/0057 473/207
6,620,052 B2 * 9/2003 Piatt ..... A63B 69/0059 473/208
6,827,654 B2 * 12/2004 Meyer ..... A63B 69/0059 24/300
6,846,254 B2 * 1/2005 Baxter ..... A63B 69/0059 473/450
6,875,135 B2 * 4/2005 Tracy, Sr. ..... A63B 69/0057 473/438
7,007,705 B1 * 3/2006 Thrower ..... A61H 3/00 135/65
7,083,528 B2 * 8/2006 Marland ..... A63B 69/0059 473/212
7,156,747 B2 * 1/2007 Perry ..... A63B 69/3667 473/217
7,156,748 B2 * 1/2007 Burke ..... A63B 69/0059 473/207
7,214,171 B2 * 5/2007 Thelen ..... A63B 21/055 482/121
7,547,256 B1 * 6/2009 Petrie ..... A63B 69/0059 473/207
7,547,257 B1 * 6/2009 Shah ..... A63B 69/3608 473/218
7,722,473 B1 * 5/2010 Shah ..... A63B 69/3608 473/218
7,758,436 B2 * 7/2010 Reynolds ..... A63B 69/0057 473/207
7,811,185 B1 * 10/2010 Reynolds ..... A63B 69/0057 473/207
7,955,236 B2 * 6/2011 DiGiovanni ..... A63B 21/0552 482/124
8,574,090 B1 * 11/2013 Veres ..... A63B 69/3667 473/217
8,992,351 B2 * 3/2015 Manou ..... A63B 71/0009 473/518
9,162,100 B2 * 10/2015 Rasnake ..... A63B 21/02
9,821,189 B1 * 11/2017 Saar ..... A63B 21/4015
10,130,545 B2 * 11/2018 Crowley ..... A61H 1/0237
2004/0097296 A1 5/2004 Snyder et al.
2009/0105005 A1 4/2009 Libby et al.
2009/0227384 A1 * 9/2009 Reynolds ..... A63B 69/0057 473/207
2012/0077652 A1 * 3/2012 Georgiades ..... A63B 21/002 482/124
2012/0264535 A1 10/2012 O'Brien

* cited by examiner

GOLF SWING AID APPARATUS AND METHODS OF USING THE SAME

The present invention claims priority to U.S. Provisional Pat. App. No. 62/678,657, titled "Golf Swing Aid Apparatus and Methods of Using the Same," filed May 31, 2018, which is incorporated by reference herein in its entirety.

TECHNICAL FIELD

The present invention relates to a golf swing aid apparatus. Specifically, the golf swing aid apparatus comprises a stretchable strap that pulls a golfer's trailing elbow downward towards his or her torso at the same time that golfer shifts his or her weight to the leading foot during a golf downswing. The stretchable strap continues pulling the golfer's trailing elbow towards his or her torso until or just before he or she strikes the golf ball, and then releases so that the golfer is free to follow through without impairment from the stretchable strap.

BACKGROUND

The game of golf has attracted and frustrated participants for hundreds of years since it was officially invented in Scotland in 1457. Indeed, it is estimated that there are today over 24 million Americans who play golf. Over 456 million rounds of golf are played annually in the United States at over 15,200 American golf courses. Clearly, golf is a very popular sport and hobby for many people. And while golf is a relatively simple game, the mechanics of a good golf swing are very complicated. An improper golf swing is one of the largest impediments to golfers and their ability to play good rounds of golf, leading to errant shots. It is no surprise, then, that an improper golf swing is a major source of frustration for many golf enthusiasts.

There are many viewpoints on how to improve a golfer's swing and the subject has generated reams of discussion concerning the "proper" golf swing. One viewpoint that is described by golf professional Harvey Penick in his book "Harvey Penick's Little Red Book, Lessons and Teachings from a Lifetime of Golf" is that to optimize a golfer's swing, the golfer's weight should shift to the lead foot on the downswing (typically the left foot for right-handed golfers) while the elbow of the trailing arm is brought down against the golfer's torso. On the upswing or backswing, the elbow of the golfer's trailing arm should go back freely and not against the golfer's torso, but upon starting the downswing, the elbow should be moved downward to the golfer's torso until the ball is struck.

In many cases, golfers have been taught to hold a towel under the armpit of their trailing arm and to keep the towel from falling during the golfer's swing. However, this is inadequate and can lead to a golfer attempting to ensure that the trailing elbow is held against the torso on the upswing, which is unnatural, restrictive, and awkward for a golfer, and which may lead to incorrect mechanics on the backswing and downswing.

As in any sport, especially a sport that requires mastery of certain mechanics, like a golf swing, a user becomes proficient through practice and repetition. However, the repetition should be consistent so that bad habits do not creep into the golf swing and cause the bad habits to be incorporated into the golf swing.

While a golf instructor may tell and even show a golfer proper swing mechanics, it is often difficult for a golfer to make his or her golf swing habitual, without causing bad habits to creep into the golf swing thereby causing the golf swing to lead to errant mishits. A golfer may wish to repetitiously practice his or her golf swing, but may not have an expert or teacher around to ensure that the golf swing is performed consistently well each time to develop the proper muscle memory.

Many devices that purport to aid a golfer to develop a better swing often are usable only during "training" sessions—that is, sessions where a golfer does not actually hit a golf ball. For example, many golf training aids utilize a band stretched between the golfer's lead foot or other body part and the golf club itself that is designed to increase the strength of the swing, not the mechanics of the swing. Moreover, this device cannot be utilized to actually hit a golf ball. In addition, it is often difficult to remove training aids in the event the golfer wishes to hit a golf ball unimpeded by the training aid.

A need, therefore, exists for an improved golf swing aid apparatus. Specifically, a need exists for an improved golf swing aid apparatus that effectively improves a golfer's swing, thereby improving the golfer's golf game.

Moreover, a need exists for an improved golf swing aid apparatus that causes a golfer's trailing elbow to move downward into a proper position against the golfer's torso on the golfer's downswing. However, a need exists for an improved golf swing aid apparatus that allows a golfer's trailing elbow to freely move on the golfer's upswing or backswing without causing the golfer to move in an unnatural or awkward manner.

In addition, need exists for an improved golf swing aid apparatus that allows the user to practice his or her golf swing with consistent repetition. Specifically, a need exists for an improved golf swing aid apparatus that causes a golfer to incorporate proper golf swing mechanics into his or her golf swing.

In addition, a need exists for an improved golf swing aid apparatus that is relatively simple to manufacture, easy and uncomplicated to use, and leads to consistent results. Moreover, a need exists for an improved golf swing aid apparatus that is comfortable to wear and may be easily attached and removed by a golfer when needed or desired.

Moreover, a need exists for an improved golf swing aid apparatus that may be utilized as a training device, without actually hitting a golf ball. Further, a need exists for a golf swing aid apparatus that may also be utilized in actually hitting a golf ball so that the mechanics developed during training can be realized when actually hitting a golf ball. Still further, a need exists for a golf swing aid apparatus that may allow a user randomly switch between utilizing the swing aid apparatus during some golf swings and not others during a practice session without the need to remove or alter the device.

SUMMARY OF THE INVENTION

The present invention relates to a golf swing aid apparatus. Specifically, the golf swing aid apparatus comprises a stretchable strap that pulls a golfer's trailing elbow downward towards his or her torso at the same time that golfer shifts his or her weight to the leading foot during a golf downswing. The stretchable strap continues pulling the golfer's trailing elbow towards his or her torso until or just before he or she strikes the golf ball, and then releases so that the golfer is free to follow through without impairment from the stretchable strap.

To this end, in an embodiment of the present invention, a golf swing aid apparatus is provided. The golf swing aid apparatus comprises: a body having a plate configured to be held to a bottom of a user's shoe; and a strap extending upwardly from the body, the strap held at a location on the body when the strap is pulled in a first direction and wherein the strap is released from the location on the body when the strap is pulled in a second direction.

In an embodiment, the golf swing aid apparatus further comprises: a recess within the body having a first surface, the first surface at the location on the body; and a second surface extending from the strap, wherein the second surface extending from the strap engages the first surface of the recess and holds the strap in the location when the strap is pulled in the first direction.

In an embodiment, the first surface is an annular surface extending less than 360 degrees to form an opening in the first surface, and wherein the opening is configured to release the second surface from the first surface when the strap is pulled in the second direction.

In an embodiment, the strap is stretchable.

In an embodiment, the strap is connected to a retractable line that extends within the body.

In an embodiment, the golf swing aid apparatus further comprises: an automatic retraction element, wherein the retractable line is attached to the automatic retraction element.

In an embodiment, the body comprises a main portion and an S-shaped portion extending from the main portion, the S-shaped portion having at least one bend; and a ring attached to a first terminal end of the strap and disposed on the S-shaped element and configured to travel on the S-shaped element, wherein the ring is configured to hold the strap at the bend at the location on the body when the strap is pulled in the first direction, and is further configured to allow the strap to travel over the S-shaped portion when the strap is pulled in the second direction.

In an embodiment, the golf swing apparatus further comprises: an arm attachment element connected to the second terminal end of the strap.

In an embodiment, the arm attachment element is a sleeve.

In an alternate embodiment of the present invention, a golf swing aid system is provided. The golf swing aid system comprises: a body having a plate configured to be held to a bottom of a user's shoe; a strap extending upwardly from the body, the strap held at a location on the body when the strap is pulled in a first direction and wherein the strap is released from the location on the body when the strap is pulled in a second direction; and an arm attachment element connected to the second terminal end of the strap configured to be worn by a golfer on the golfer's trailing arm during a golf swing.

In an embodiment, the strap is stretchable.

In an embodiment, the body comprises a recess therein, the recess having a first surface at the location on the body, wherein the strap comprises a second surface extending from the strap, wherein the second surface extending from the strap engages the first surface of the recess and holds the strap in the location when the strap is pulled in the first direction.

In an embodiment, the first surface is an annular surface extending less than 360 degrees to form an opening in the first surface, and wherein the opening is configured to release the second surface of the strap from the first surface when the strap is pulled in the second direction.

In an embodiment, the strap is connected to a retractable line that extends within the body.

In an embodiment, the golf swing aid system further comprises: an automatic retraction element, wherein the retractable line is attached to the automatic retraction element.

In an embodiment, the body comprises a main portion and an S-shaped portion extending from the main portion, the S-shaped portion having at least one bend, and wherein the strap comprises a ring attached to a first terminal end of the strap and disposed on the S-shaped element and configured to travel on the S-shaped element, wherein the ring is configured to hold the strap at the bend at the location on the body when the strap is pulled in the first direction, and is further configured to allow the strap to travel over the S-shaped portion when the strap is pulled in the second direction.

In an embodiment, the arm attachment element is a sleeve.

In an alternate embodiment of the present invention, a method of using a golf swing aid system is provided. The method comprises the steps of: providing a golf swing aid apparatus comprising a body having a plate configured to be held to a bottom of a user's shoe, a strap extending upwardly from the body, the strap held at a location on the body when the strap is pulled in a first direction and wherein the strap is released from the location on the body when the strap is pulled in a second direction, and an arm attachment element connected to the second terminal end of the strap configured to be worn by a golfer on the golfer's trailing arm during a golf swing; attaching the arm attachment element to a user's trailing arm at a location at or near the user's elbow of the user's trailing arm; stepping on the plate by the user so that the plate is held on the bottom of the user's shoe on the user's leading foot during a golf swing; holding the strap at the location on the body as the user pulls the user's trailing arm back in a backswing of golf swing thereby pulling the user's trailing elbow toward the user's torso during the backswing and downswing; and releasing the strap from the location thereby freeing the user's trailing arm during a follow through of a golf swing after striking a golf ball.

In an embodiment, the body comprises a recess therein, the recess having a first surface at the location on the body, wherein the strap comprises a second surface extending from the strap, wherein the second surface extending from the strap engages the first surface of the recess and holds the strap in the location when the strap is pulled in the first direction.

In an embodiment, the body has a main portion and an S-shaped portion extending from the main portion, the S-shaped portion having at least one bend, and wherein the strap comprises a ring attached to a first terminal end of the strap and disposed on the S-shaped element and configured to travel on the S-shaped element, wherein the ring is configured to hold the strap at the bend at the location on the body when the strap is pulled in the first direction, and is further configured to allow the strap to travel over the S-shaped portion when the strap is pulled in the second direction.

It is, therefore, an advantage and objective of the present invention to provide an improved golf swing aid apparatus.

Specifically, it is an advantage and objective of the present invention to provide an improved golf swing aid apparatus that effectively improves a golfer's swing, thereby improving the golfer's golf game.

Moreover, it is an advantage and objective of the present invention to provide an improved golf swing aid apparatus that causes a golfer's trailing elbow to move downward into a proper position against the golfer's torso on the golfer's downswing.

Further, it is an advantage and objective of the present invention to provide an improved golf swing aid apparatus that allows a golfer's trailing elbow to freely move on the golfer's upswing without causing the golfer to move in an unnatural or awkward manner.

In addition, it is an advantage and objective of the present invention to provide an improved golf swing aid apparatus that allows the user to practice his or her golf swing with consistent repetition.

Specifically, it is an advantage and objective of the present invention to provide an improved golf swing aid apparatus that causes a golfer to incorporate proper golf swing mechanics into his or her golf swing.

Further, it is an advantage and objective of the present invention to provide an improved golf swing aid apparatus that is relatively simple to manufacture, easy and uncomplicated to use, and leads to consistent results.

Still further, it is an advantage and objective of the present invention to provide an improved golf swing aid apparatus that is comfortable to wear and may be easily attached and removed by a golfer when needed or desired.

Moreover, it is an advantage and objective of the present invention to provide an improved golf swing aid apparatus that may be utilized as a training device, without actually hitting a golf ball.

Further, it is an advantage and objective of the present invention to provide an improved golf swing aid apparatus that may also be utilized in actually hitting a golf ball so that the mechanics developed during training can be realized when actually hitting a golf ball.

Still further, it is an advantage and objective of the present invention to provide a golf swing aid apparatus that allows a user to randomly switch between utilizing the swing aid apparatus during some golf swings and not others during a practice session without the need to remove or alter the device. This convenient and seamless transition between choosing to engage the device to assist the user in pulling the trail elbow downward toward the torso during the downswing on some swings and not others throughout a series of consecutive swings will help the user develop the proper feel and skill in a shorter period of time.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a golf swing aid apparatus. Specifically, the golf swing aid apparatus comprises a stretchable strap that pulls a golfer's trailing elbow downward towards his or her torso at the same time that golfer shifts his or her weight to the leading foot during a golf downswing. The stretchable strap continues pulling the golfer's trailing elbow towards his or her torso until or just before he or she strikes the golf ball, and then releases so that the golfer is free to follow through without impairment from the stretchable strap.

Figure 1:
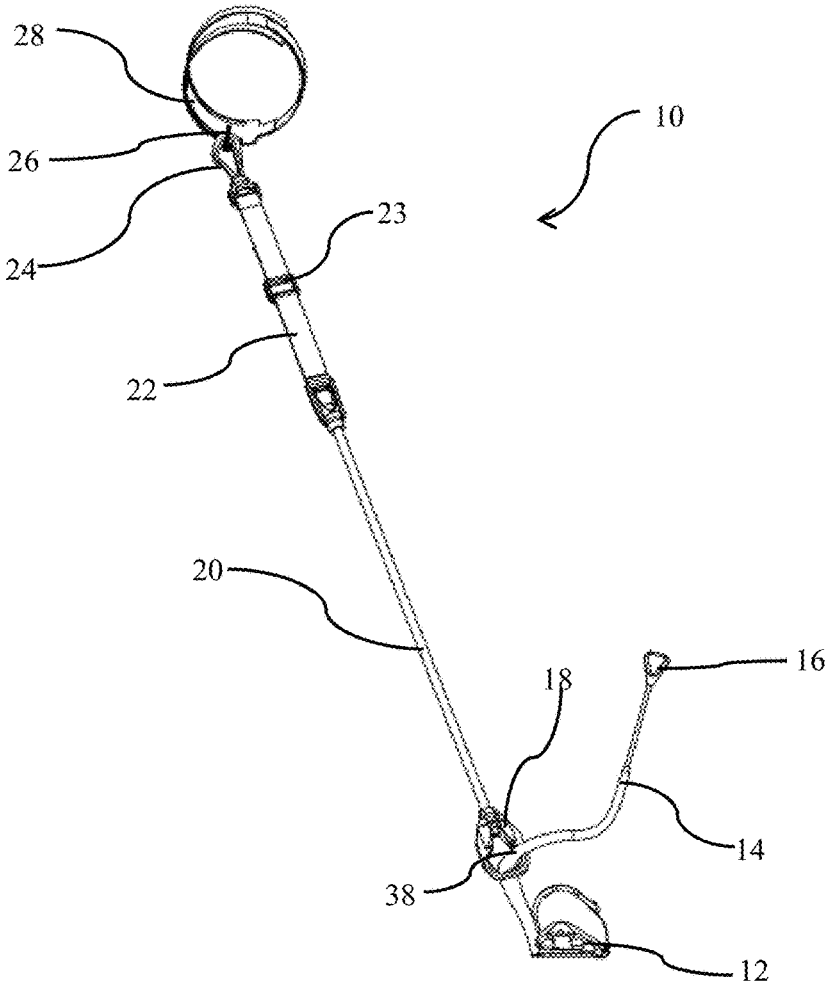
FIG. 1 illustrates a front perspective view of a golf swing aid apparatus in an embodiment of the present invention.

Now referring to the drawings, a golf swing aid apparatus 10 is illustrated in FIG. 1. The golf aid apparatus 10 comprises various components, including a foot brace 12 having an upwardly extending "S"-shaped rod 14 extending from the trailing side edge of the foot brace 12. The S-shaped rod 14 further may have a stopper 16 on a distal end thereof. A ring 18 may be disposed around the S-shaped rod 14 such that the ring 18 may travel the length of the S-shaped rod 14, but may be blocked from traveling fully off of the S-shaped rod due to the stopper 16.

Extending from the ring 18 may be a stretchable strap 20 that may preferably be made from an elastic material that allows the same to stretch upon application of a stretching force but retain its original shape when the stretching force ceases. The stretchable strap 20 may be connected to an adjustable strap 22 having an adjustment buckle 23 and a clip 24 on a distal end thereof, wherein the clip 24 may be connected, via a connector 26 to a sleeve 28 that may be worn on an upper part, a lower part, or, more preferably, over the elbow of a trailing arm of a golfer as he or she swings a club at a golf ball. The adjustable strap 22 may be lengthened or shortened, as needed based on the size and/or strength of the golfer via the adjustment buckle 23. Alternatively, the stretchable strap 20 may be connected directly to the sleeve 28 without the adjustment buckle 23. Moreover, the sleeve 28 may be in the form of a wrap, a ring, a strap, or other like element that can hold the terminal end of the stretchable strap 20 in position to pull the user's elbow downwardly during a backswing and, more preferably, a downswing.

Figure 2:
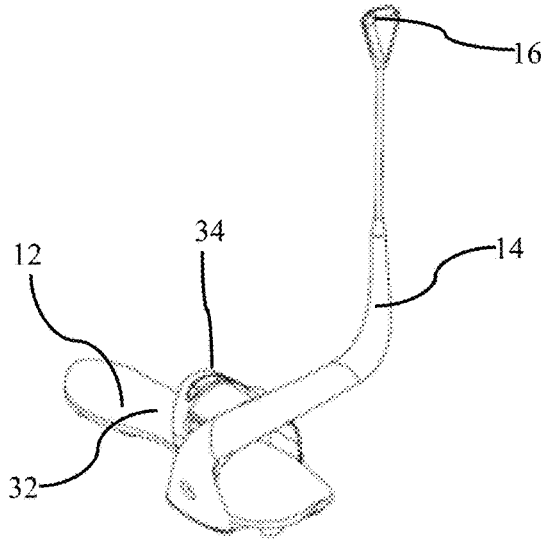
FIG. 2 illustrates a side perspective view of a foot brace of a golf swing aid apparatus in an embodiment of the present invention.
Figure 3:
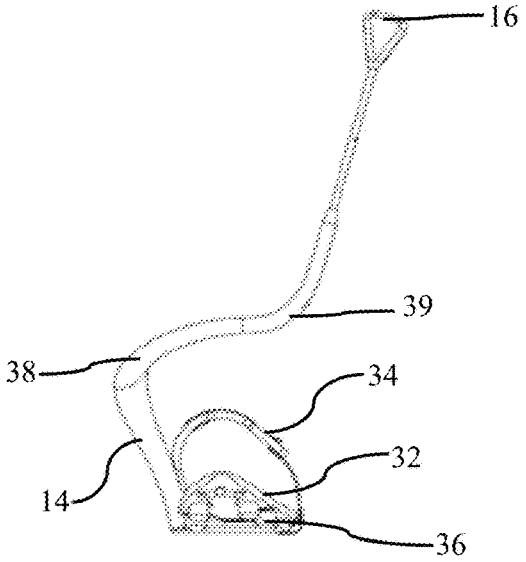
FIG. 3 illustrates a front view of a foot brace of a golf swing aid apparatus in an embodiment of the present invention.

FIG. 2 illustrates a side perspective view of the foot brace 12 of the golf swing aid apparatus 10, wherein the foot brace further comprises a platform 32 having an adjustable strap and buckle 34 disposed thereon. A golfer may place his or her shoe onto the platform 32 and hold the brace 12 thereto via the adjustable strap and buckle 34. The S-shaped rod 14 may extend from the trailing side edge of the brace 12. As illustrated in FIG. 3, the platform 32 may have spikes or other treads 36 on a bottom side thereof that may reduce slipping of the golfer's foot on the grass when in use. In addition, the platform 32 may have a tread on a top side thereof that may hold a golfer's shoe in place when the golfer places his or her foot within the foot brace 12.

Figure 4:
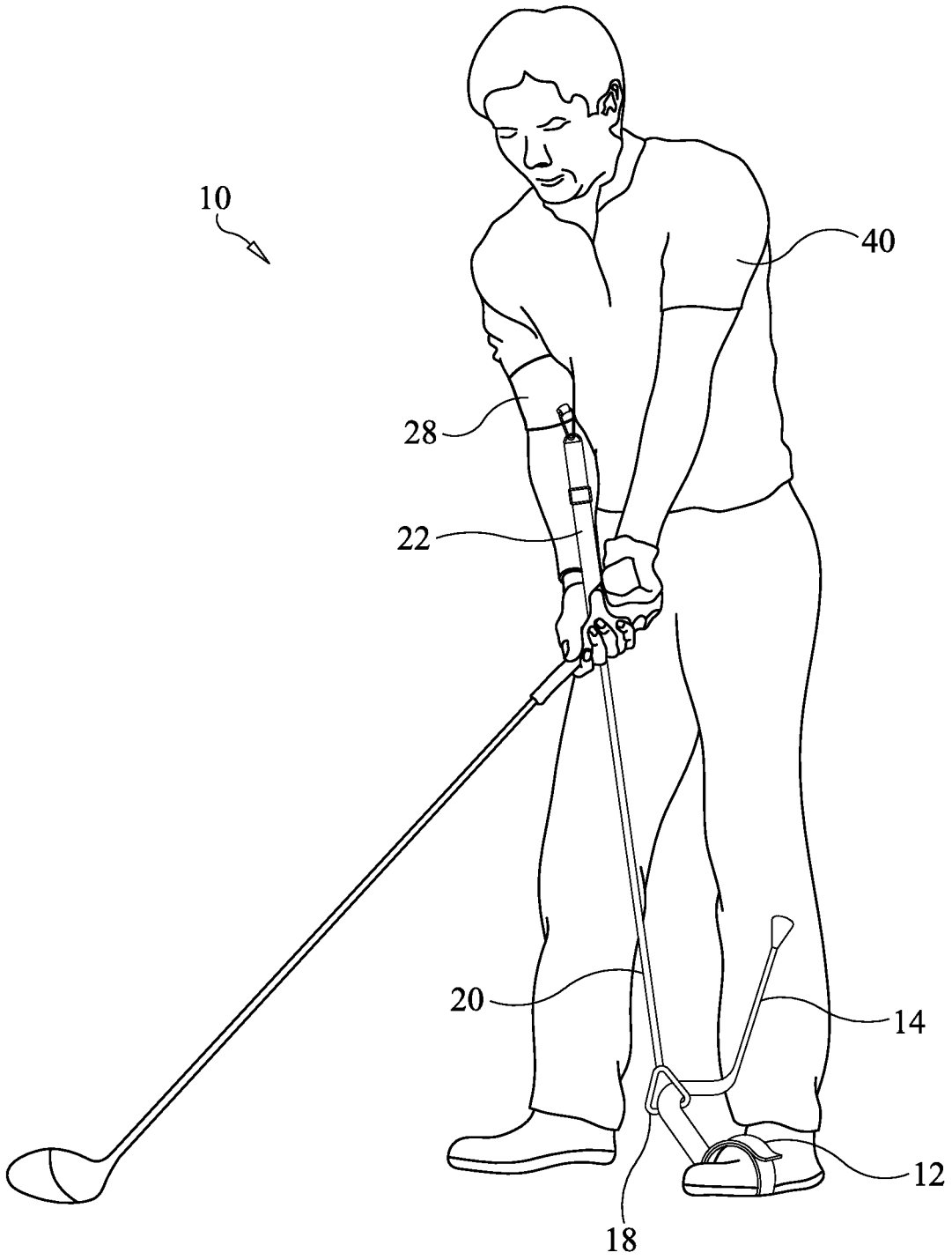
FIG. 4 illustrates a side perspective view of a golfer using a golf swing aid apparatus in an embodiment of the present invention.
Figure 5A:
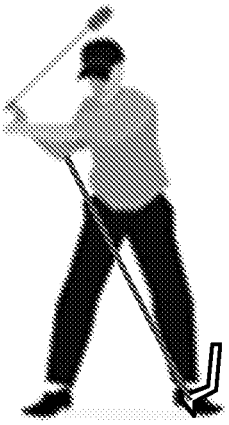
FIGS. 5A-5D illustrates a series showing front views of a golfer using a golf swing aid apparatus in an embodiment of the present invention.
Figure 5B:
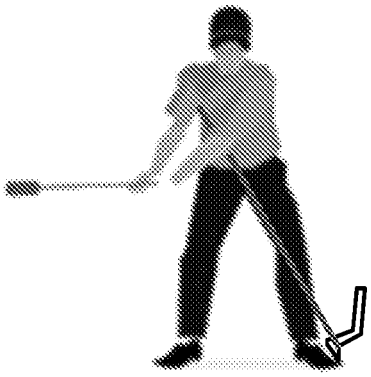
Figure 5C:
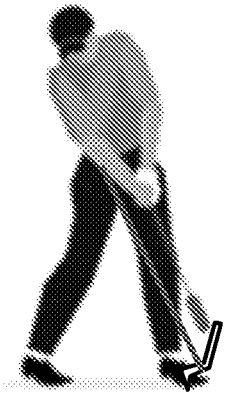
Figure 5D:
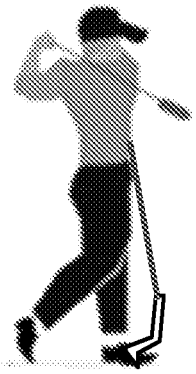
Figure 6:
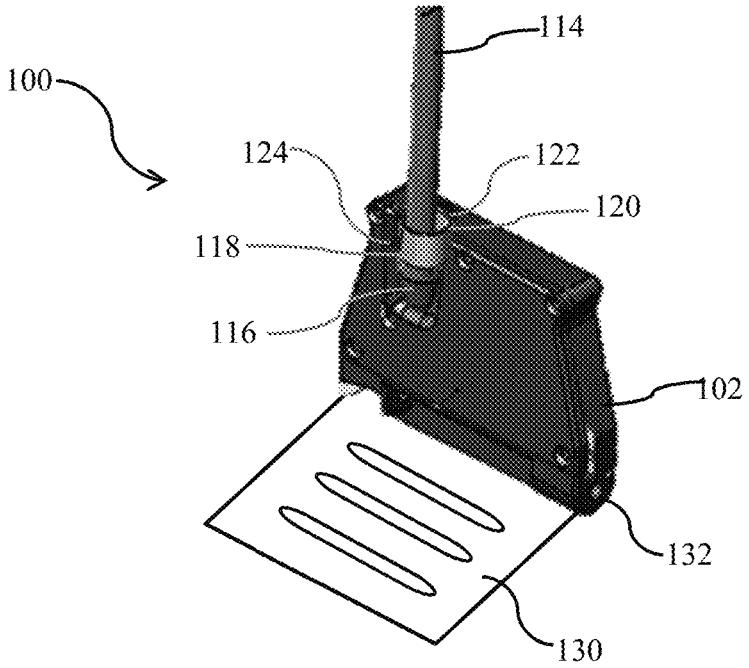
FIG. 6 illustrates a perspective view of a golf swing aid apparatus in an alternate embodiment of the present invention.

The S-shaped rod 14, as illustrated in FIG. 3 may extend upwardly from a trailing side edge of the platform 32 and may further have a first bend 38 therein, whereupon the S-shaped rod 14 may extend over the platform 32 to a second bend 39 therein, thereby extending the S-shaped rod upwardly therefrom until it terminates at its distal end having the stopper 16 thereon. As illustrated in FIG. 1, when the strap 20 is disposed across the golfer's body, as illustrated in FIG. 4, the ring 18 may be held at the first bend 38. Therefore, during the golfer's backswing and until about the point where the golfer strikes the ball, the ring 18 may be held at the first bend 38 causing tension in the stretchable strap 20. Thus, during the back swing, the stretchable strap 20 may stretch and further provide tension to the trailing elbow of the golfer, wearing the sleeve 28 thereon. However, the tension is typically not too great to prevent the golfer from positioning the golfer's elbow away from the golfer's body, as desired on the upswing or backswing. The tension may also provide a reminder to the golfer that, on the downswing, the elbow of the golfer's trailing arm should move downward to the upper torso.

When the golfer changes the golf club's direction and begins the downswing of the golf club, the golfer shifts his or her weight from the trailing foot to the leading foot and the golfer's trailing arm and, specifically, the golfer's trailing elbow, may simultaneously be pulled downward toward the golfer's torso via the tension within the stretchable strap 20, caused by the ring 18 held at the first bend 38 of the S-shaped rod 14.

The strap 20 may further be adjustable to provide more or less tension on the user's trailing elbow, as described above. Specifically, a user may desire for the strap to prevent or limit the range of motion of the user's trailing elbow during the backswing, such as if the user has a so-called "wild" elbow. The tension of the strap may be set to prevent large movements of the elbow. Moreover, tension may be increased during "training" sessions to impart a large pull on the user's elbow. Likewise, the tension of the strap may also be decreased to accommodate users that may not wish to have a large pull on his or her elbow by the strap 20, but merely to provide a slight tug to remind the user to drop his or her elbow toward the torso during the downswing as he or she shifts weight to the leading foot. For example, after training with the apparatus 10 without hitting a golf ball with a large amount of tension in the strap 20, the user may wish to decrease the tension when he or she actually strikes a golf ball while using the apparatus.

As illustrated in FIGS. 5A-5D, when the golf club strikes the golf ball and the golf club passes the position of the golf ball, the stretchable strap 20 may move forwardly of the golfer from the trailing side to the leading side of the golfer, and the ring 18 may be released from the first bend 38. At this time, as the golfer follows through his or her golf club, the ring 18 may traverse the S-shaped rod 14 past the first bend 38, over the second bend 39 and toward the distal end thereof toward the stopper 16. The stopper 16 may prevent the ring 18 from separating from the S-shaped rod 14.

In an embodiment, the S-shaped rod may be specifically shaped and sized so that a proper follow through of the golf club allows the ring 18 to traverse the S-shaped rod 14 without or with minimal resistance. Likewise, if the golfer follows through with incorrect mechanics, then the ring 18 may not cleanly traverse the S-shaped rod, and may resist traveling thereover, providing a reminder to the user that his or her follow through is incorrect.

In an alternate embodiment of the present invention, the length of the S-shaped rod 14 may be adjustable. Specifically, the S-shaped rod 14 may be extended or contracted as desired to aid in providing feedback to a user regarding the user's follow through. Specifically, a golfer may wish to extend the length of the S-shaped rod and, thus, the distance the ring 18 must travel to reach the stopper 16. Therefore, an improper follow through may show that the ring 18 does not reach the stopper 16, thereby indicating that the golfer's follow through is incorrect. Alternatively, a proper follow through may show that the ring 18 does reach the stopper 16, thereby indicating to the golfer that the golfer's follow through is correct.

Upon setting himself or herself up again to take another swing at the golf ball, the ring 18 may fall back to the first bend 38 as the golfer pulls his or her trailing arm back during the back swing, thereby applying the tension to cause the strap 20 to stretch, and the motion as described above may be repeated.

Therefore, as noted above, when the golfer moves into the downswing from the backswing, upon shifting his or her weight from the trailing foot to the leading foot, the tension on the upper trailing arm due to the stretchable strap 20 may cause the trailing elbow of the golfer to be pulled toward the golfer's torso. By maintaining this motion, the golfer may swing his or her club properly "on plane", approaching the golf ball on a shallower path and creating more lag, thereby striking the ball with greater power and consistency. Repeated use of the golf swing aid apparatus 10, as described herein, may impart the required muscle memory, and ultimately aid a golfer to use the correct swinging motion when he or she removes the golf aid apparatus 10.

The present invention may be utilized by either right-handed or left-handed golfers. The figures shown herein show a golf aid apparatus for use with a right-handed golfer, but a similar golf aid apparatus may be configured for a left-handed golfer as well. For purposes of the present invention, the "trailing" arm of the golfer is the arm that is on the back side of the golf ball and the "leading" arm of the golfer is the arm that is on the front side of the golf ball. Moreover, the golf swing aid apparatus 10 may also be utilized in both "training" mode (i.e, without actually hitting a golf ball) and in "hitting" mode (i.e., hitting a golf ball). The motion produced with the golf aid apparatus 10, as described above, is the same whether a golf ball is hit or not, and thus may be utilized simply to produce muscle memory in the golfer, and without requiring a golf ball to be hit. Likewise, the motion may be transferred to the situation when the golf ball is actually hit, thereby reinforcing the motion and providing feedback to the golfer.

Thus, in the present invention, the golfer may wear the sleeve 28 on his or her trailing arm and the strap may be disposed across his or her body on a front thereof to the brace 12 that may be worn on the leading foot of the golfer. FIG. 4 illustrates a golfer 40 wearing the golf aid apparatus 10. Specifically, the brace 12 is worn on the golfer's leading foot and the strap 20 is held in place by the ring 18 disposed at the first bend 38. As the golfer 40 shifts his or her weight on the downswing, and thereby swings through, the ring 18 may be released from the bend 38 and move forwardly and up the S-shaped rod toward the distal end thereof toward the stopper 16, as illustrated in FIGS. 5A-5D.

In an alternate embodiment of the present invention, a golf swing aid apparatus may include the arm band disposed on an upper trailing arm or elbow of the golfer, and a strap extending therefrom. Preferably, the strap extending from the arm band is elastic and stretchable so that the golfer may stretch the strap during the backswing. However, the instead of connecting to the S-shaped rod, as described above, the strap may be connected to a belt or strap worn on the golfer's torso. Specifically, the strap extending from the arm band may extend across the front of the golfer's torso to the belt or strap on the leading side of the golfer's torso. Therefore, when the golfer pulls his or her golf club back in the backswing, the strap extending from the arm band may stretch, providing tension on the upper arm and trailing elbow of the golfer, such that when the golfer begins his downswing, the strap may pull his or her trailing arm and, therefore, his or her trailing elbow in toward his or her torso. When the golfer strikes the ball, the strap extending from the arm band may release allowing the golfer to follow through without impediment.

The present invention may also be utilized to optimize the mechanics of an athlete's swinging motion in other sports requiring the same, such as, for example, baseball and/or tennis. Specifically, embodiments of the present invention may be utilized to simultaneously tuck the user's elbow against the user's torso upon shifting the user's weight on the forward part of a user's swing.

Figure 7:
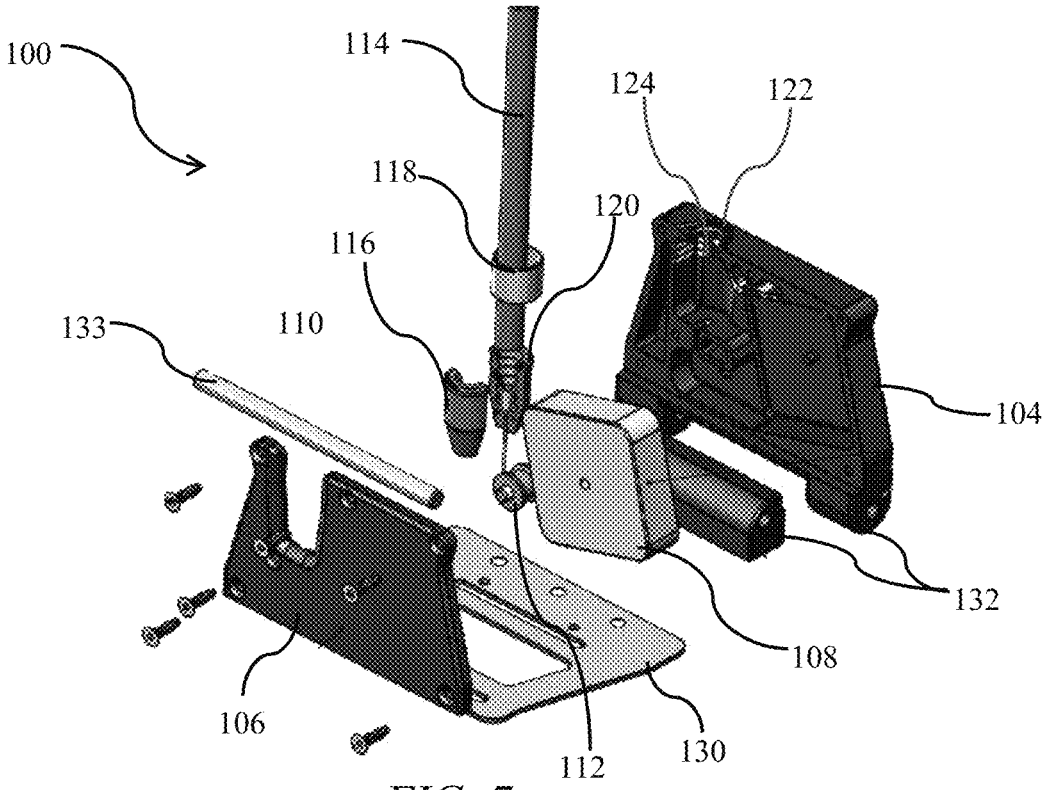
FIG. 7 illustrates an exploded view of a golf swing aid apparatus in an embodiment of the present invention.
Figure 8:
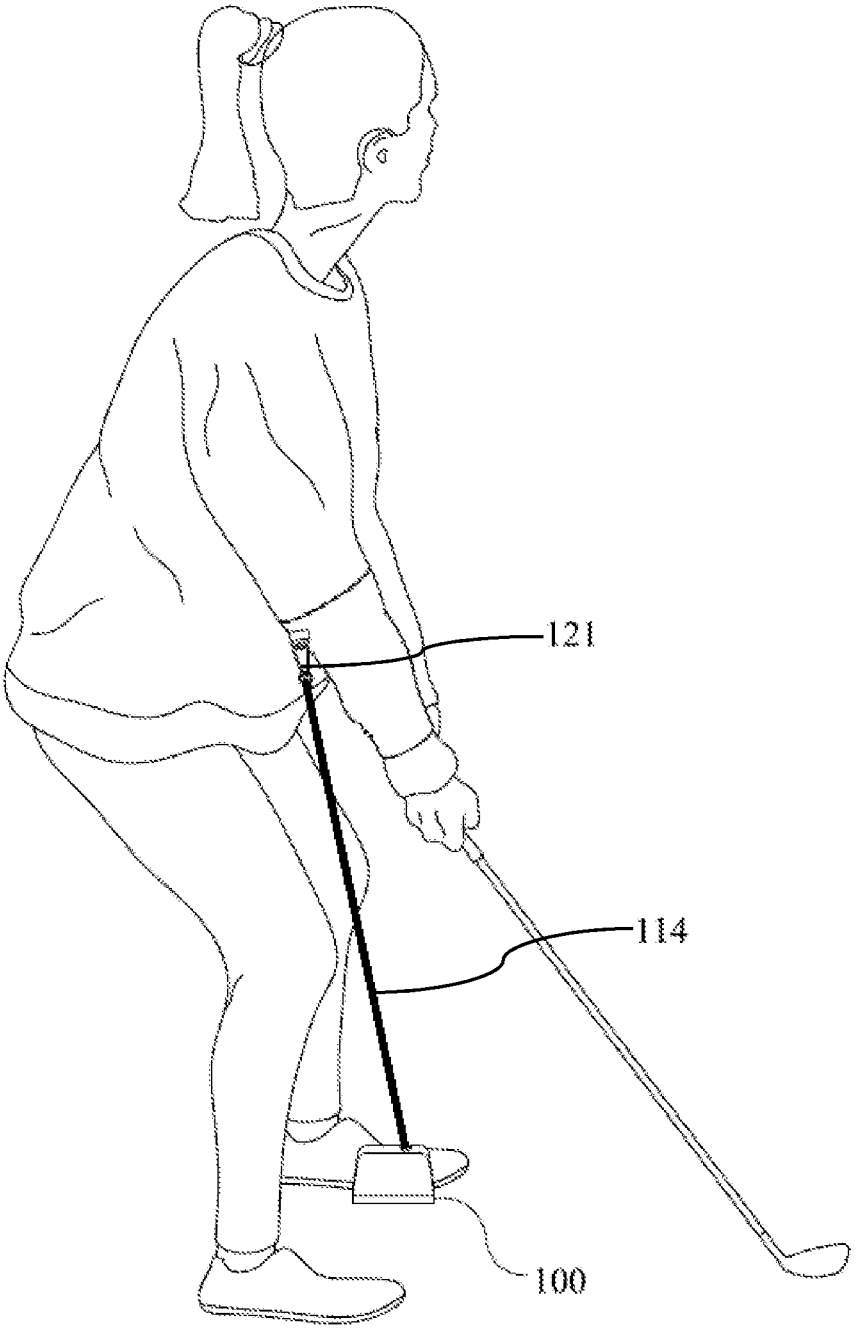
FIG. 8 illustrates a golf aid apparatus in use by a user thereof in an embodiment of the present invention.
Figure 9A:
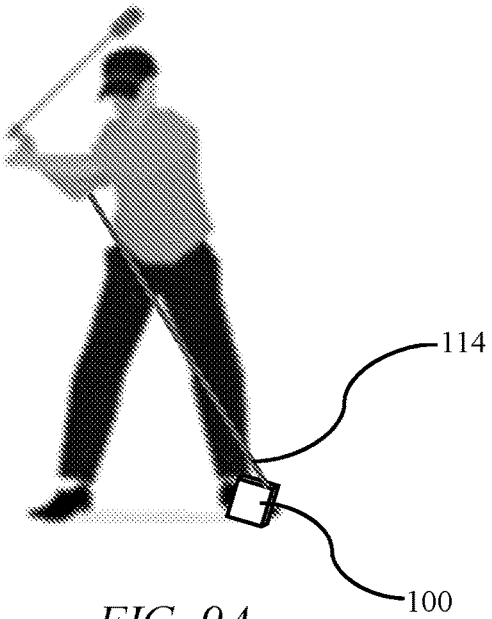
FIGS. 9A-9B illustrates front views of a golf aid apparatus in several swing positions in an embodiment of the present invention.
Figure 9B:
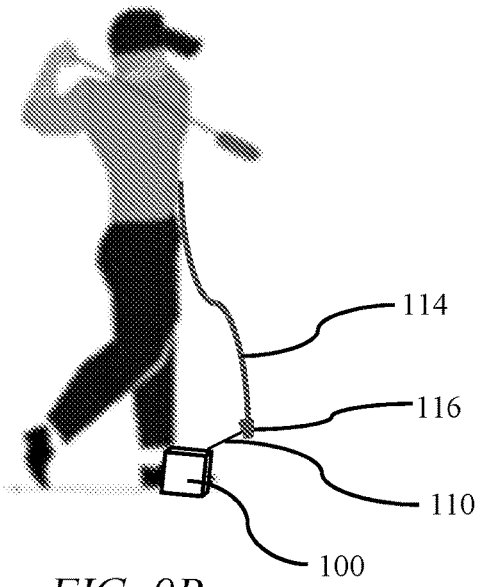

In yet another alternate embodiment of the present invention, illustrated in FIGS. 6-11B, a golf aid apparatus 100 is illustrated. The golf aid apparatus comprises a body 102 having a shell with a first body shell half 104 and a second body shell half 106 that form the body 102 having a space therein, as illustrated in FIG. 7. Within the body 102 may be a spring box 108 in which a retractable line 110 may be wound and disposed therein, as illustrated in FIG. 7. The retractable line 110 may extend from the spring box 108 around a fly wheel 112 and may be attached to a strap 114. A plug 116 (shown bifurcated in FIG. 7) having a band 118 that wraps therearound may be connected to the strap 114 at the location where the retractable line is attached to the strap 114. The plug 116 and/or the band 118 has a top surface 120 on an upper side thereof that engages a mating surface 122 on the body 102. The mating surface 122 may be a partial annular ring having a space 124 through which the plug 116 and band 118 may be placed. The top surface of 120 may therefore engage the mating surface 122 on an underside of the annular ring to hold the plug 116 in place under the annular ring. When pulled generally upwardly, the plug 116 is held in place beneath the annular ring.

Figure 11A:
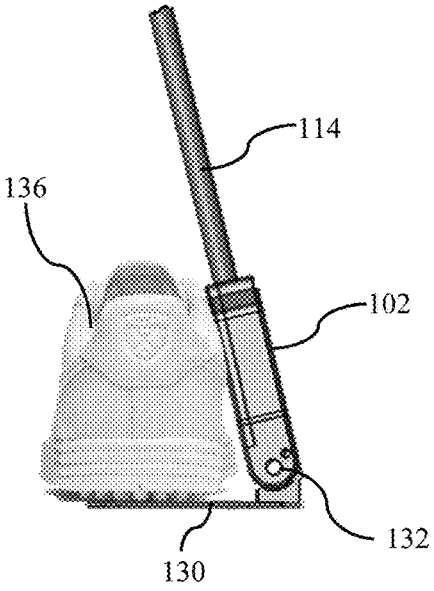
FIGS. 11A-11B illustrate a rear views of a golf aid apparatus in different pivot positions in an embodiment of the present invention.
Figure 11B:
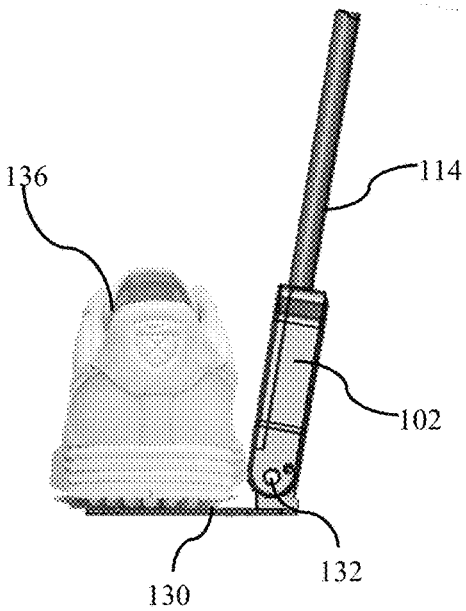

The golf aid apparatus 100 may further comprise a plate 130 connected to the body 102 on an underside thereof allowing a golfer to stand on the plate 130 when in use. Shoe straps (not shown) may also be utilized for holding the apparatus 100 on the golfer's shoe when the golfer desires to use the same. The body 102 may be hingedly connected via hinge 132 to the plate 130 with hinge pin 133, as illustrated in FIG. 7, allowing the body 102 to pivot with respect to the plate 130, as illustrated in FIGS. 11A-11B and described in more detail below.

When in use, as illustrated in FIGS. 8, 9A-9B, and 10A-10B, a user may stand on the plate 130, placing the shoe of his leading foot on the plate 130. Straps (not shown) may hold the user's shoe to the plate 130, if necessary. The strap 114, shown truncated in FIGS. 6, 7, 10A-10B, and 11A-11B may be strapped to the user's trailing arm, preferably at or near the elbow thereof, via a sleeve 121 in the same manner as described above with respect to the embodiment shown in FIGS. 1-5. The plug 116 may be placed within the recess 124 and the upper surface 120 of the band 118 may engage the mating surface 122 of the body 102, thereby holding the strap 114 in place within the body 102.

When the user pulls his or her trailing arm backward in a back swing prior to hitting a golf ball, the strap 114 may act to limit his or her range of motion of the trailing elbow, as described above, and may further act to pull the user's trailing arm and, more specifically, his or her elbow toward his or her torso, thereby maintaining the elbow in a tucked-in position, during the downswing as the club approaches the golf ball prior to impact and as the user shifts his or her weight to the leading foot. In a preferred embodiment, the strap 114 may be stretchable so as to stretch out when the user pulls his or her trailing arm back in the backswing, and recoil when he or she drops his or her trailing arm in the downswing. The recoil may apply sufficient pressure to either remind the user to keep his or her trailing arm elbow tucked in toward his or her torso, or may have significant force to actively pull the user's elbow toward his or her torso on the downswing.

Figure 10A:
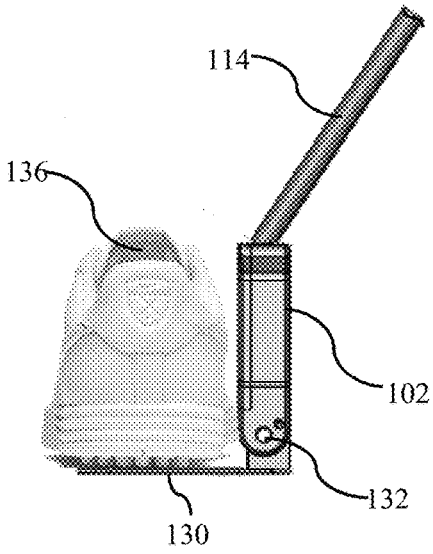
FIGS. 10A-10B illustrate rear views of a golf aid apparatus in an embodiment of the present invention.
Figure 10B:
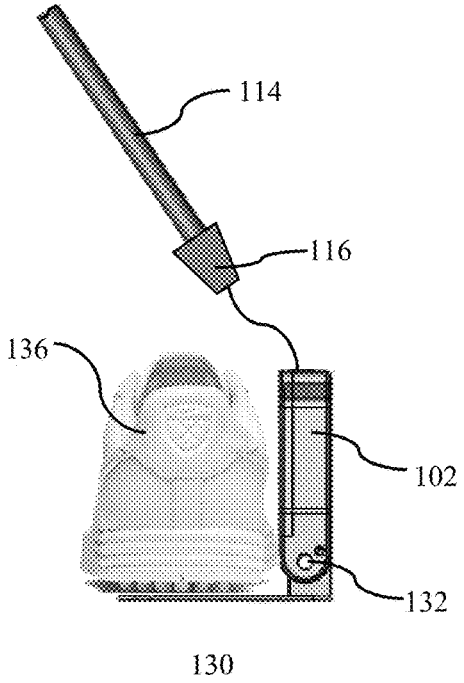

As the golf club strikes the ball and the user's arm passes over the apparatus 100, the plug 116 and band 118 of the strap 114 may be pulled out of the recess 124, thereby releasing the plug 116 and the band 118 from the recess 124, as illustrated in FIG. 10B. Thus, the user's trailing arm may be freed from the pressure placed thereon by the strap 114 holding his or her arm in the tucked-in position during the downswing. Therefore, during the follow-through of the user's swing, the trailing arm may be free to extend as necessary without impingement from the strap 114.

To aid in resetting the strap 114 within the body 102, the retractable line 110 may extend from the plug 116 and may further extend from spring box 108, allowing the strap 114 to freely extend when separated from the body 102. When a user thereafter desires to "reset" the apparatus 100, he or she drops his or her trailing arm, and the spring box 108 pulls the line 110 and, therefore, the plug 116, band 118, and strap 114 to hold the strap 114 within the body 102 so that the user can take another swing in the same manner as described above. Alternatively, the user may use the apparatus without resetting the strap 114 within the body 102, giving the user complete freedom of movement. In such a situation, the user may wish to use the apparatus in training or in some cases, but may wish to not be impacted by the apparatus at times. Thus, if not reset, then the user may swing his or her golf club without any tension on his or her elbow. Therefore, the user may easily switch between using the apparatus for training purposes and not using the apparatus when desired without removal or altering of the apparatus. This convenient and seamless transition between choosing to engage the device to assist the user in pulling the trailing elbow downward toward the torso during the downswing on some swings and not others throughout a series of consecutive swings may help the user develop the proper feel and skill in a shorter period of time.

FIGS. 10A and 10B illustrate the body 102 in generally a configuration that is perpendicular to the plate 130 and, therefore, generally perpendicular to the ground. By pivoting the body 102 toward the user's shoe 136 forming an acute angle between the body 102 and the plate 130, as illustrated in FIG. 11A, the mating surface 122 may be positioned at more severe angle, making it more difficult to release the strap 114 from the body 102 without significant movement of the trailing arm and elbow toward the torso and through the follow-through. Thus, an experienced golfer may wish to make the release of the strap 114 from the body 102 more difficult to aid in his or her training by angling the body 102 of the apparatus 100 toward his or her shoe 136.

Likewise, a beginner may require that the strap 114 release more easily from the body 102, and thus the body 102 may be angled away from the user's leading foot forming an obtuse angle between the body 102 and the plate 130, as illustrated in FIG. 11B. Thus, the angle of the mating surface 122 in such a configuration may allow the plug 116 and, thus, the strap 114 to release more easily from the body 102 to ensure that the strap 114 does not interfere with the user during the follow through of the golf swing. Therefore, the golf aid apparatus 102 may be tweaked for the particular skill of the user thereof, by pivoting the body 102 relative to the plate 130.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are non-limiting, and it should be noted that claim limitations presented herein are not meant to describe the invention as a whole. Moreover, the invention illustratively disclosed herein suitably may be practiced in the absence of any element which is not specifically disclosed herein.

We claim:

1. A swing aid apparatus comprising:

a body configured to be held to a user's leading shoe;

a holding element at a location on the body;

a strap extending upwardly from the body, the strap held by the holding element at the location on the body when the strap is pulled in a first direction and the strap further held at or near a user's trailing elbow during the user's backswing of a club or a bat used in a sport, and wherein the strap is released from the holding element on the body when the strap is pulled in a second direction during the user's follow through of the swing.

2. The swing aid apparatus of claim 1 wherein the holding element comprises a recess within the body having a first surface, the first surface at the location on the body; and a second surface extending from the strap, wherein the second surface extending from the strap engages the first surface of the recess and holds the strap in the location when the strap is pulled in the first direction.

3. The swing aid apparatus of claim 2 wherein the first surface is an annular surface extending less than 360 degrees to form an opening in the first surface, and wherein the opening is configured to release the second surface from the first surface when the strap is pulled in the second direction.

4. The swing aid apparatus of claim 1 wherein the strap is stretchable.

5. The swing aid apparatus of claim 2 wherein the strap is connected to a retractable line that extends within the body.

6. The swing aid apparatus of claim 5 further comprising:

an automatic retraction element, wherein the retractable line is attached to the automatic retraction element.

7. The swing aid apparatus of claim 1 further comprising:

the body having a main portion and the holding element comprising an S-shaped portion extending from the main portion, the S-shaped portion having at least one bend; and a ring attached to a first terminal end of the strap and disposed on the S-shaped element and configured to travel on the S-shaped element, wherein the ring is configured to hold the strap at the bend at the location on the body when the strap is pulled in the first direction, and is further configured to allow the strap to travel over the S-shaped portion when the strap is pulled in the second direction.

8. The swing aid apparatus of claim 1 further comprising:

an arm attachment element connected to the second terminal end of the strap.

9. The swing aid apparatus of claim 8 wherein the arm attachment element is a sleeve.

10. A golf swing aid apparatus comprising:

a body configured to be held to a user's shoe;

a strap extending upwardly from the body, the strap held at a location on the body when the strap is pulled in a first direction and held at or near a user's trailing elbow during the user's backswing of a golf swing and wherein the strap is released from the location on the body when the strap is pulled in a second direction during a user's follow through of the golf swing;

a recess within the body having a first surface, the first surface at the location on the body; and a second surface extending from the strap, wherein the second surface extending from the strap engages the first surface of the recess and holds the strap in the location when the strap is pulled in the first direction.

11. The golf swing aid apparatus of claim 10 wherein the first surface is an annular surface extending less than 360 degrees to form an opening in the first surface, and wherein the opening is configured to release the second surface from the first surface when the strap is pulled in the second direction.

12. The golf swing aid apparatus of claim 10 wherein the strap is stretchable.

13. The golf swing aid apparatus of claim 10 wherein the strap is connected to a retractable line that extends within the body.

14. The golf swing aid apparatus of claim 13 further comprising:

an automatic retraction element, wherein the retractable line is attached to the automatic retraction element.

15. The golf swing aid apparatus of claim 10 further comprising:

an arm attachment element connected to the second terminal end of the strap.

16. The golf swing aid apparatus of claim 15 wherein the arm attachment element is a sleeve.

17. A golf swing aid apparatus comprising:

a body configured to be held to a user's shoe;

a strap extending upwardly from the body, the strap held at a location on the body when the strap is pulled in a first direction and held at or near a user's trailing elbow during the user's backswing of a golf swing and wherein the strap is released from the location on the body when the strap is pulled in a second direction during a user's follow through of the golf swing;

the body having a main portion and an S-shaped portion extending from the main portion, the S-shaped portion having at least one bend; and a ring attached to a first terminal end of the strap and disposed on the S-shaped element and configured to travel on the S-shaped element, wherein the ring is configured to hold the strap at the bend at the location on the body when the strap is pulled in the first direction, and is further configured to allow the strap to travel over the S-shaped portion when the strap is pulled in the second direction.

18. The golf swing aid apparatus of claim 17 further comprising:

an arm attachment element connected to the second terminal end of the strap.

19. The golf swing aid apparatus of claim 18 wherein the arm attachment element is a sleeve.

* * * * *